US010188926B2

(12) United States Patent
O'Malley

(10) Patent No.: US 10,188,926 B2
(45) Date of Patent: Jan. 29, 2019

(54) MARTIAL ARTS TRAINING DEVICE

(71) Applicants: St. John Thomas Vincent, St. Louis, MO (US); Bailey O'Malley, Runaway Bay, Queensland (AU)

(72) Inventor: Bailey O'Malley, Runaway Bay (AU)

( * ) Notice: Subject to any disclaimer, the term of this patent is extended or adjusted under 35 U.S.C. 154(b) by 0 days.

(21) Appl. No.: 15/356,569

(22) Filed: Nov. 19, 2016

(65) Prior Publication Data

US 2017/0197135 A1 Jul. 13, 2017

(30) Foreign Application Priority Data

Jan. 8, 2016 (KR) ..... 10-2016-0002749

(51) Int. Cl.

| | |
|---|---|
| ***A63B 69/00*** | (2006.01) |
| ***A63B 69/26*** | (2006.01) |
| ***A63B 69/34*** | (2006.01) |
| ***A63B 71/12*** | (2006.01) |

(52) U.S. Cl.

CPC ..... *A63B 69/26* (2013.01); *A63B 69/004* (2013.01); *A63B 69/34* (2013.01); *A63B 71/1225* (2013.01); *A63B 2071/125* (2013.01); *A63B 2071/1233* (2013.01); *A63B 2071/1241* (2013.01); *A63B 2071/1258* (2013.01); *A63B 2244/106* (2013.01)

(58) Field of Classification Search

CPC ... A63B 69/0059; A63B 69/26; A63B 69/345; A63B 69/004; A63B 21/4017; A63B 21/4019; A63B 21/4021; F41H 5/08

See application file for complete search history.

(56) References Cited

U.S. PATENT DOCUMENTS 2,574,046 A * 11/1951 Logan ..... A63B 69/26 2/455
3,370,302 A * 2/1968 Karlyn ..... F41H 5/08 128/846
4,546,966 A * 10/1985 Segura ..... A63B 69/26 482/86

(Continued)

FOREIGN PATENT DOCUMENTS

| | | |
|---|---|---|
| JP | 3086162 | 3/2002 |
| KR | 20-2000-0016508 | 9/2000 |
| KR | 10-2007-0051323 | 5/2007 |

OTHER PUBLICATIONS

Extended European Search Report.

*Primary Examiner* — Loan H Thanh
*Assistant Examiner* — Rae Fischer
(74) *Attorney, Agent, or Firm* — Lee & Associates, LLC

(57) ABSTRACT

Disclosed is a martial arts training device that is worn on a trainer's waist, and a pair of movable leg-strike units provided on the outer surface of both legs of the trainer are controlled at similar directions, speeds and strengths to real kicking, such that defensive and offensive training simulating a real fight may be performed as the trainee defends from and strikes the movable leg-strike units. The martial arts training device according to the present invention includes a waist-mounted unit worn on a trainer's waist, and a pair of movable leg-strike units, each movably connected to opposite sides of the waist-mounted unit and having a handle on the outer surface thereof to allow a trainer to perform a movable operation thereof.

11 Claims, 9 Drawing Sheets

(56) References Cited

U.S. PATENT DOCUMENTS

| | | | | |
|---|---|---|---|---|
| 5,147,258 | A * | 9/1992 | Donohue | A63B 69/205 482/83 |
| 5,209,691 | A | 5/1993 | Ekstein | |
| 2009/0280969 | A1 | 11/2009 | Simith | |
| 2010/0105531 | A1* | 4/2010 | Crawford | A63B 21/00185 482/124 |
| 2013/0224707 | A1 | 8/2013 | Newkirk | |
| 2015/0099611 | A1 | 4/2015 | Lyman et al. | |

* cited by examiner

MARTIAL ARTS TRAINING DEVICE

CROSS REFERENCE TO RELATED APPLICATION

The present application claims priority to Korean Patent Application No. 10-2016-0002749 filed on Jan. 8, 2016, the entire contents of which is incorporated by reference herein for all purposes.

TECHNICAL FIELD

The present disclosure relates to a martial arts training device allowing trainees who train in martial arts to receive actual defensive and offensive training simulating a real fight.

BACKGROUND

Generally, punching with fists and kicking with feet are both allowed in martial arts including taekwondo, kickboxing and karate. A variety of techniques such as striking with elbows or knees are used in kickboxing, muay thai, etc., and choking, locking, holding, etc. are used in judo, sambo, jujitsu, wrestling, etc. All of the mentioned disciplines and techniques are integrated into Mixed Martial Arts (MMA), which has recently gained in popularity.

For striking training, trainees who train in martial arts use punch bags or punch pads as if they were opponents. Usually, punch bags are used when a trainee trains alone, and when the trainee trains with his trainer, the trainer wears some kind of punch pads. For the sake of convenience, the trainer(s) and the trainee(s) will be described as males.

A punch bag hung from the ceiling or which stands on the floor is used for striking practice. To prevent accidents or injury, a buffer material for absorbing the shock from punching or kicking is found in the punch bag. However, the punch bag is only available for offensive training, and defensive training is not possible.

In case of punch pads, a trainer usually wears the punch pads on a part of his body such as hands or arms. Like punch bags, a buffer material for absorbing the shock from punching or kicking is also provided in the punch pads so that injury or accidents may be prevented. The punch pads have a feature that they are used for both offensive training and defensive training. In case of the punch pads, both defensive and offensive punching or striking with elbows may be practiced. However, training for kicking or striking with knees is limited with punch pads.

That is, the punch pads may be used for offensive training using punching and elbow striking, and defense training wherein the trainee defends himself when a trainer wearing the punch pads attacks the trainee. Moreover, the training may be conducted at similar directions, speeds and strengths of punching and elbow striking that may occur in an actual fight. This is because the punch pads are put on both hands or both arms of the trainer who can freely move.

However, as kicking and knee strike training is performed with a trainer who wears punch pads on his hands or arms, the training motions would differ from a real fight situation. Offensive training wherein the trainee kicks the punch pads worn on the trainer's hands or arms is possible; however, for example, if two or more low kicks, middle kicks, high kicks, front kicks, knee kicks, etc. are mixed, it is not possible to train effectively simulating an actual fight. This is because the trainer should change the positions of the punch pads in accordance to the kicking directions by the trainee. However, if the order is not familiar both to the trainer and to the trainee, the exercise is not possible. In addition, if the training is done only according to the order that is agreed, this would be different from an actual fight, thereby the training effect would be lowered.

Also, if the trainer attacks the trainee with the punch pads, the trainee can practice defense training. However, as this method uses only the upper torso such as hands or arms and not the legs or knees, the exercise would be done in directions, speeds and strengths completely different from an actual fight.

In addition, for a counter-offense after defense, the trainee may only punch toward the punch pads from a stationary position, which is undesirable. Further, because of the danger of injury to the trainer and the trainee, kicking or knee strikes cannot be done at the same directions, speeds and strengths as an actual fight.

The foregoing is intended merely to aid in the understanding of the background of the present disclosure, and is not intended to mean that the present disclosure falls within the preview of the related art that is already known to those skilled in the art.

SUMMARY OF THE INVENTION

The present disclosure relates to a martial arts training device enabling both defensive and offensive training, owing to a pair of movable leg-strike units movably provided at opposite sides of a waist-mounted unit.

An exemplary embodiment provides a martial arts training device including: a waist-mounted unit worn on a trainer's waist; and movable leg-strike units each movably connected to opposite sides of the waist-mounted unit, the leg-strike units each having a handle on an outer surface thereof to allow a trainer to perform a movable operation thereof.

According to a preferred feature of an exemplary embodiment, the waist-mounted unit is in the form of a waist belt.

According to a preferred feature of an exemplary embodiment, the waist-mounted unit has a wider width at a part thereof to encounter the lower torso portion of a trainer, so as to be supported on the concerned portion.

According to a preferred feature of an exemplary embodiment, the movable leg-strike unit includes an outer cover movably connected to the opposite sides of the waist-mounted unit, and a cushion member provided inside the outer cover.

According to a preferred feature of an exemplary embodiment, an opening and closing member for separation from the cushion member is provided in the outer cover.

According to a preferred feature of an exemplary embodiment, the outer cover is formed of a material such as leather, artificial leather, fiber and artificial fiber materials, the cushion member is formed of a material such as compressed sponge, formed rubber, formed silicon resin, and latex.

According to a preferred feature of an exemplary embodiment, the outer cover and the cushion member are formed with a cylindrical shape.

According to a preferred feature of an exemplary embodiment, the length of the movable leg-strike unit corresponds to the average leg length of an adult, and the top of the movable leg-strike unit is positioned at a height corresponding to the hip-joint portion of a trainer.

According to a preferred feature of an exemplary embodiment, the movable leg-strike unit is movably connected by a strap member formed of fiber or artificial fiber materials to the opposite sides of the waist-mounted unit.

According to a preferred feature of an exemplary embodiment, the movable leg-strike unit is movably connected by a ball-joint or other connecting member formed of metal or synthetic resin materials to the opposite sides of the waist-mounted unit.

According to a preferred feature of an exemplary embodiment, the movable leg-strike unit is movably connected to the opposite sides of the waist-mounted unit by a chain member formed of metal or synthetic resin materials.

According to a preferred feature of an exemplary embodiment, the movable leg-strike units are movably connected to the opposite sides of the waist-mounted unit by a string member formed of metal or synthetic resin materials According to a preferred feature of an exemplary embodiment, an arm-binding member into which the arm of a trainer who is holding the handle is positioned on over the handle at the outer surface of the movable leg-strike unit.

According to a preferred feature of an exemplary embodiment, the arm-binding members in plural are separately arranged in up and down directions on the outer surface of the movable leg-strike unit.

According to a preferred feature of an exemplary embodiment, an arm-supporting cushion member for elastically or adjustably supporting the arm of the trainer who is holding the handle is provided on the outer surface of the movable leg-strike unit.

According to a preferred feature of an exemplary embodiment, a wrist-protecting cushion member for protecting the wrist of the trainer who is holding the handle is provided on the bottom of the arm-supporting cushion member.

According to a preferred feature of an exemplary embodiment, a reinforcement pad is provided in the front lower part of the movable leg-strike unit.

The embodiment provides a pair of movable leg-strike units worn by the trainer. The directions, speeds, and strengths of the leg-strike units can be controlled similar to actual kicking of human fighters. This is advantageous for receiving defensive and offensive training applicable in actual fights, whereby the trainee confronts the movable leg-strike units by both defending from and attacking them.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION OF THE INVENTION

Figure 1:
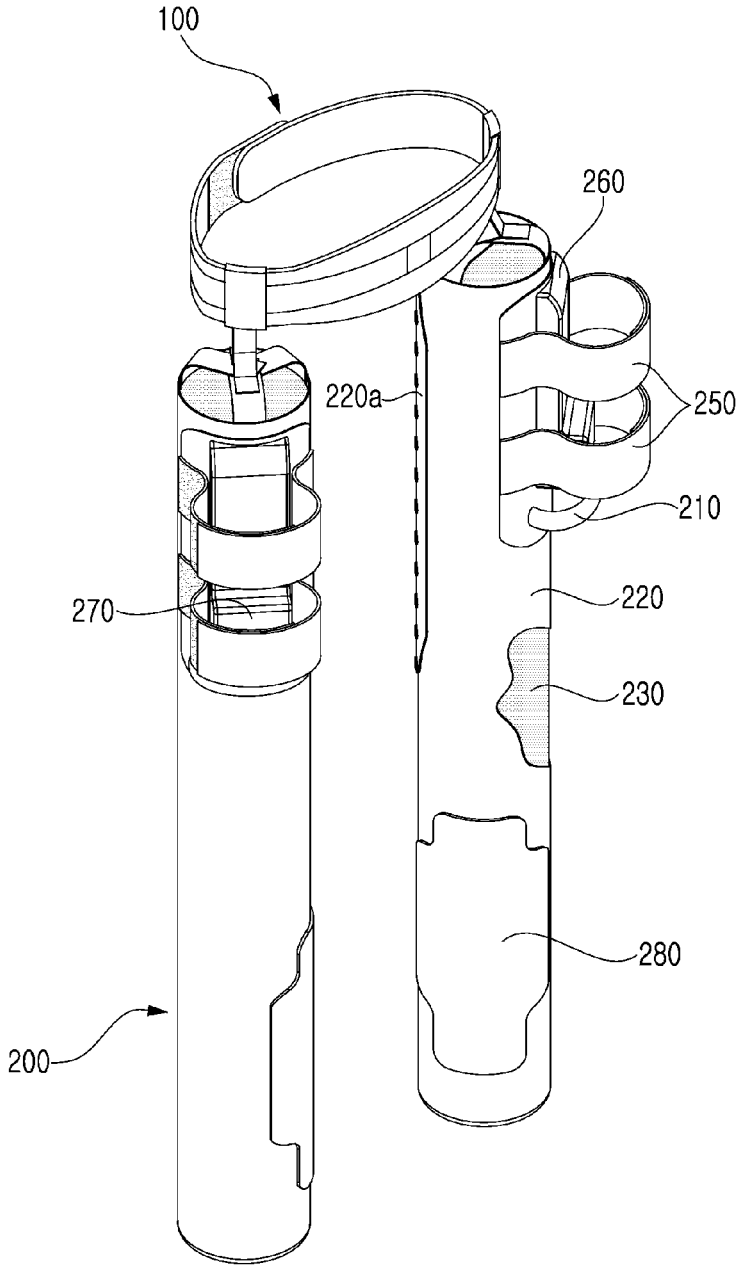
FIG. 1 is a prospective view showing a martial arts training device according to an exemplary embodiment.

Hereinbelow, preferred exemplary embodiments will be described in reference to the drawings attached hereto. However, it should be understood that the attached drawings are for illustrative purposes to explain the embodiments in details to such a degree that those having ordinary knowledge in the art to which the present disclosure pertains can easily implement it. It shall not be interpreted to imply that the technical idea and category of the present disclosure shall be limited thereby.

The martial arts training device according to the present disclosure includes a waist-mounted unit 100 mounted on a trainer's waist, and movable leg-strike units 200 respectively connected to opposite sides of the waist-mounted unit 100 and having a holding handle 210 on the outer surface thereof to enable a movable operation by the trainer.

The waist-mounted unit 100 is to fix the martial arts training device to a part of the trainer's body, which is mounted on the trainer's waist. The waist-mounted unit 100 is formed of a waist belt whose length may be adjusted. To allow the waist-mounted unit 100 to be supported on the lower torso portion of the trainer, a part thereof to encounter the concerned portion has a wider width than the other parts. Owing to this, as the waist-mounted unit 100 may be more firmly fixed to the lower torso portion of the trainer, this prevents the waist-mounted unit 100 from being turned when the movable leg-strike units 200 to be described below are used. The length of the waist-mounted unit 100 may be adjusted according to one of the methods of adjusting the length of the waist belt.

The movable leg-strike units 200 are movably connected to the opposite sides of the waist-mounted belt 100 described above. Motion of the movable leg-strike units 200 is controlled by the trainer, thus enabling the trainee to train both defensively and offensively.

The movable leg-strike units 200 each include an outer cover 220 connected to the waist-mounted unit 100, and a buffer material 230 provided inside the outer cover 20. The movable leg-strike unit 200 has a corresponding length to the average leg length of the adults so as to maximize the effect of actual kicking, and the top end thereof is positioned at the position corresponding to the trainer's hip joint. Accordingly, as the movable leg-strike unit 200 may be moved similarly as mimicking actual kicking by an adult, the trainee can train more effectively. At this time, the outer cover 220 and the buffer material 230 constituting the movable leg-strike unit 200 may be formed in a cylindrical shape, and it may be changed diversely into a shape similar to the actual legs of a human being.

The outer cover 220 is provided with an opening and closing member 220*a* to allow the buffer material 230 to be separated therefrom. As the opening and closing member 220*a*, any one of a zipper, a button, or Velcro (hook-and-loop fastener) that can open and close the outer cover 220 may be selectively used. Also, the outer cover 220 is formed of one of leather, artificial leather, fiber and synthetic fiber materials, and the buffer material 230 is formed of one of compressed sponge, foamed rubber, formed silicon resin or latex. As both the outer cover 220 and the buffer material 230 are made of smooth materials, the trainer and the trainee can both train simulating actual fights without the danger of injury.

A handle 210 whose movable operation may be performed by the trainer is also provided on each of the movable leg-strike units 200. The handles 210 are fixedly positioned on the movable leg-strike units 200, but the height thereof may also be adjusted according to the physical condition of the trainer. With holding the handle 210, the trainer moves the movable leg-strike units 200 toward the trainee at diverse directions, speeds, and strengths to simulate a low kick, a middle kick, a high kick, a front kick, etc.

An arm-binding member 250 is provided on the outer surface of the movable leg-strike unit 200, and it is to fix the lower arm portion of the trainer who is holding the handle 210. The arm-binding member 250 is positioned over the handle 210, and multiple arm-binding members 250 are separately arranged in up and down directions. The length thereof may also be adjusted to be in close contact with the lower arm of the trainer.

An arm-supporting cushion member 260 for supporting the trainer's arm is provided on the outer surface of the movable leg-strike unit 200, and it is smoothly contacted with the lower arm of the trainer fixedly positioned on the arm-supporting cushion member 260 when the trainer holds the handle 210. The arm-supporting member 260 is positioned over the handle 210 and inside the arm-binding member 250. In the process that the movable leg-strike unit 200 is repeatedly moved by the trainer, the lower arm portion of the trainer suffers from steady friction with the outer cover 220. The discomfort due to the friction may be relieved by the arm-supporting cushion member 260 and the trainer's lower arm may be protected and prevented from injury.

A wrist-protecting cushion member 270 for protecting a wearer's wrist is provided on the arm-supporting cushion member 260 by protruding thereon, and it supports the wrist of the trainer who is holding the holding handle 210. The wrist of the trainer holding the holding handle 210 receives steady shock due to the weight of the movable leg-strike unit 200 and repeated motion and impacts. As the wrist-protecting cushion member 270 protrudes on the bottom of the arm-supporting member 260, the trainer's wrist may be stably supported and protected from injury.

A reinforcement pad 280 is provided on the front lower part of the movable leg-strike unit 200, and it is to protect the outer cover 220 of the movable leg-strike unit 200, which is repeatedly used. The reinforcement pad 280 is made of the same material as the outer cover 220 and it may be replaced with a new one 280 if it is worn or torn due to repeated use.

The movable leg-strike units 200 described above may be movably connected to opposite sides of the waist-mounted unit 100 by use of diverse means.

Figure 2:
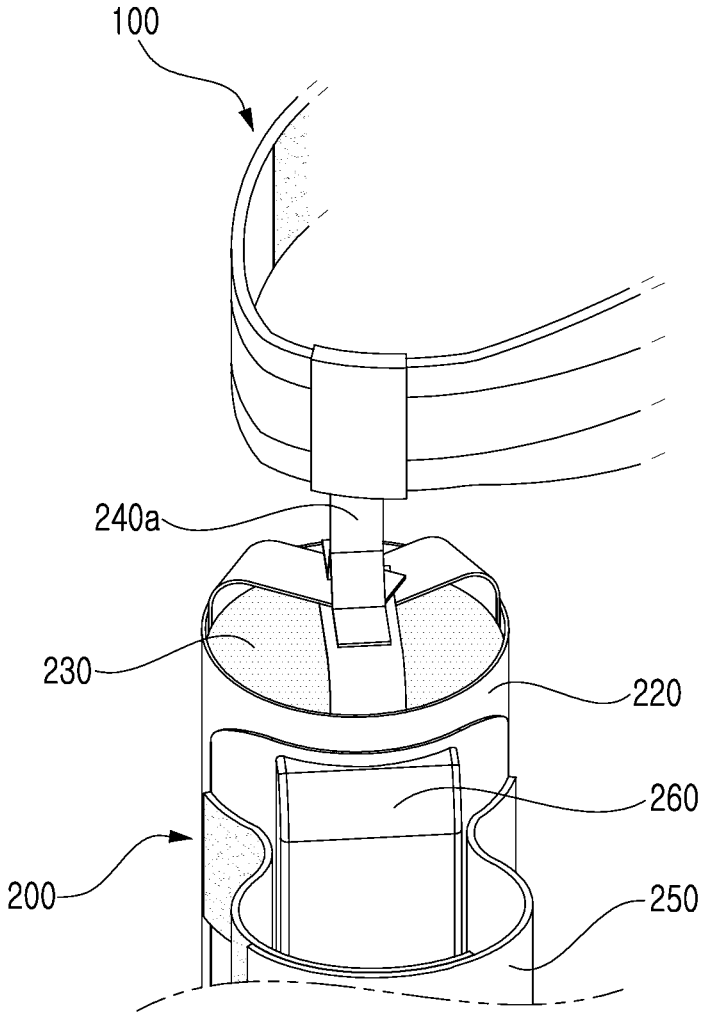
FIGS. 2 to 5 are exploded views showing a portion at which the movable leg-strike units are connected to the waist-mounted unit, in the martial arts training device according to an exemplary embodiment.

As shown in FIG. 2, the movable leg-strike units 200 may be movably connected to the opposite sides of the waist-mounted unit 100 by a strap member 240*a* formed of fiber or synthetic fiber materials.

Figure 3:
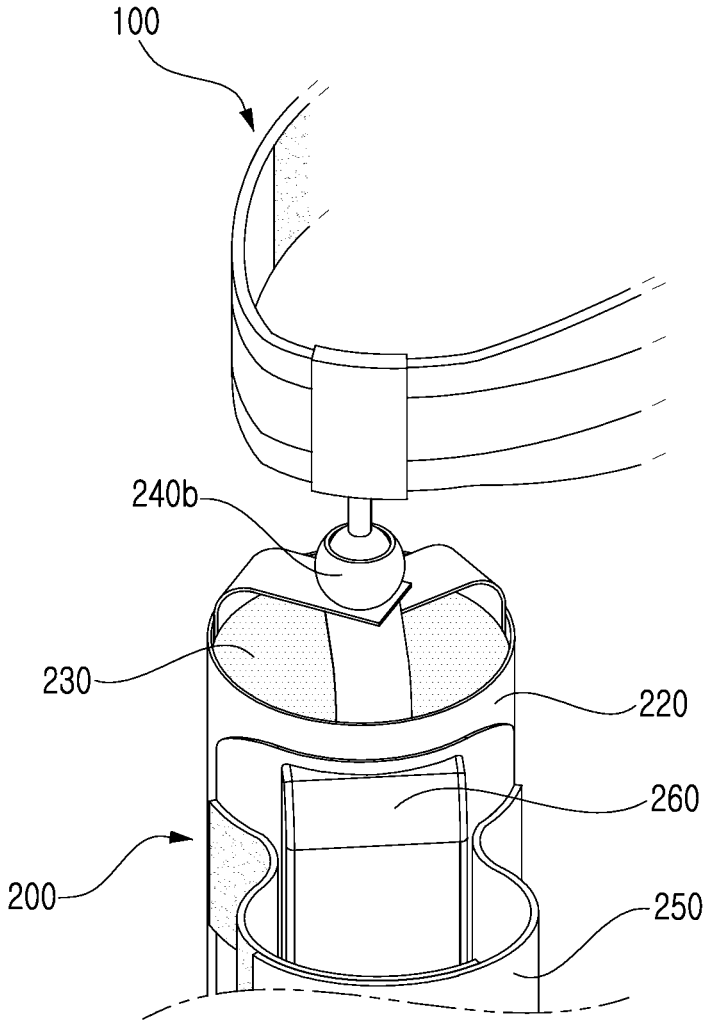

As shown in FIG. 3, the movable leg-strike units 200 may be movably connected to the opposite sides of the waist-mounted unit 100 by a ball-joint connecting member 240*b* produced by metal or synthetic resin materials.

Figure 4:
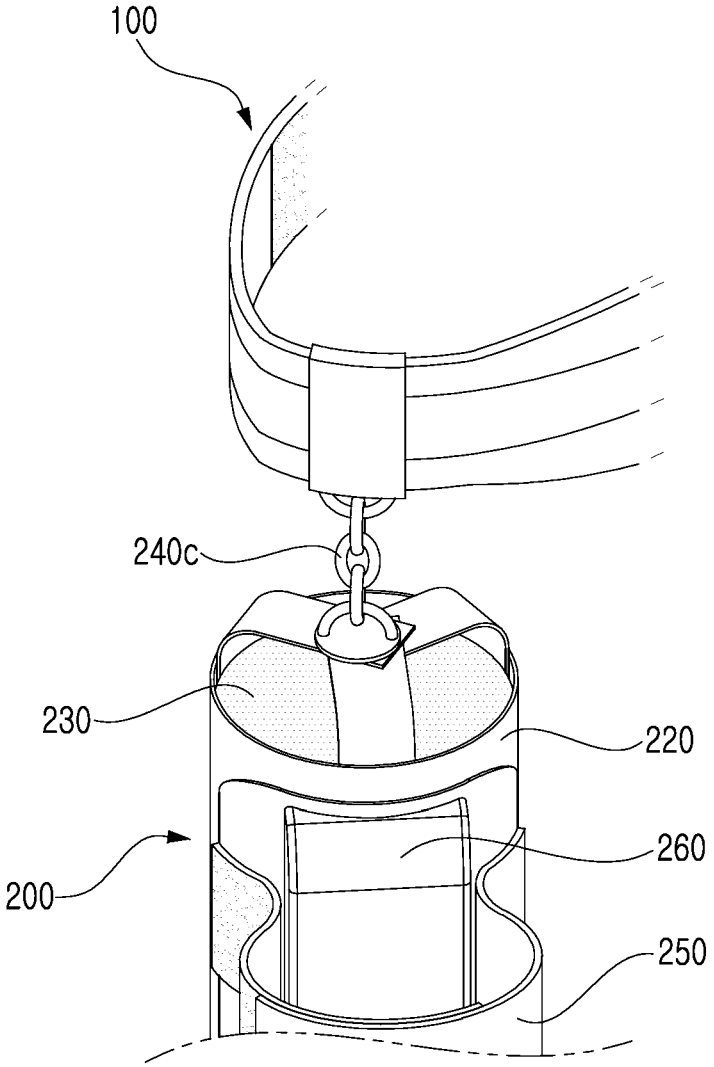

As shown in FIG. 4, the movable leg-strike units 200 may be movably connected to the opposite sides of the waist-mounted unit 100 by a chain member 240*c* made of metal or synthetic resin materials.

Figure 5:
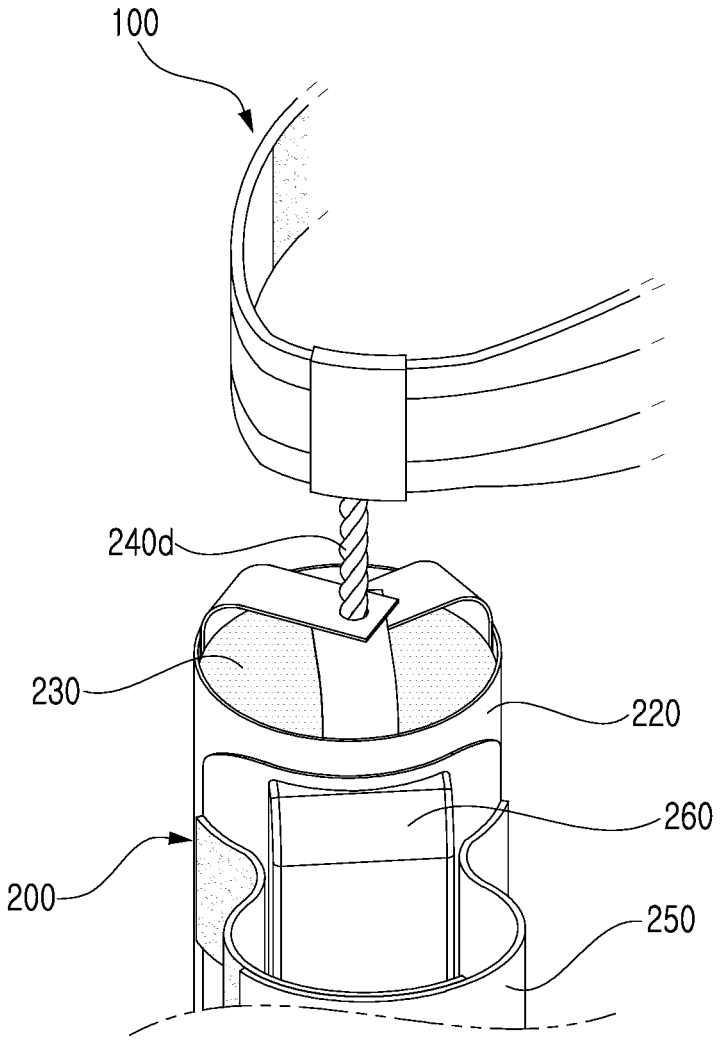
Figure 6:
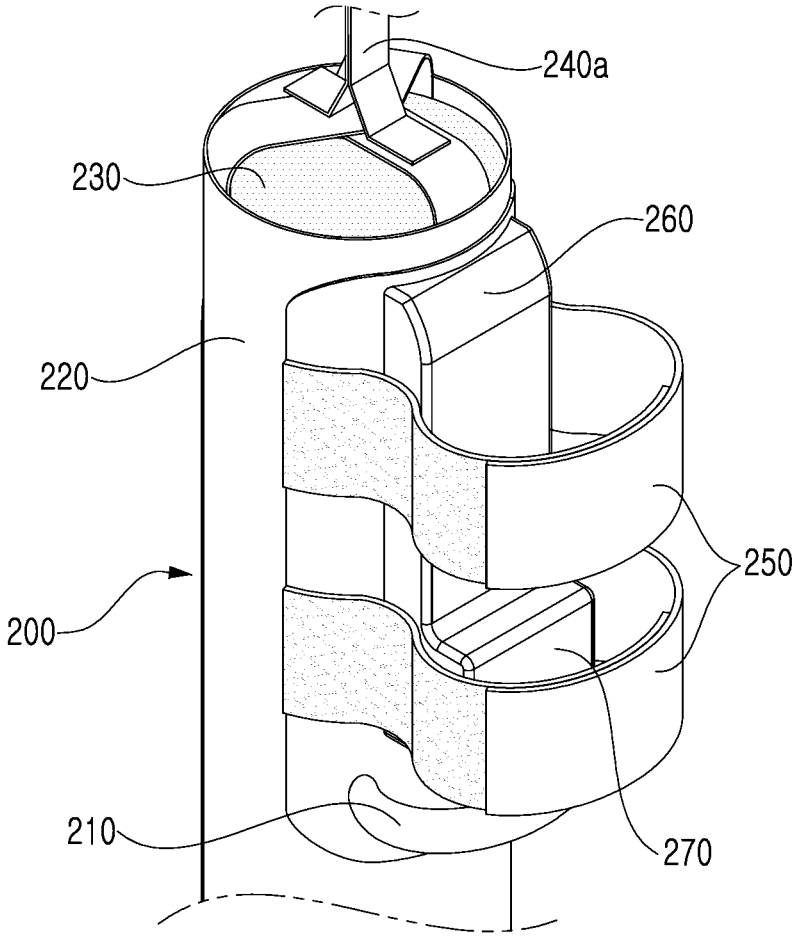
FIG. 6 is an exploded view showing a handle, in the martial arts training device according to an exemplary embodiment.

As shown in FIG. 5, the movable leg-strike unit 200 may be movably connected to the opposite sides of the waist-mounted unit 100 by a string member 240*d* produced by metal or synthetic resin materials.

In the present disclosure, it has been described that the movable leg-strike units 200 may be connected to the waist-mounted unit 100 by the strap member 240*a*, the ball-joint connecting member 240*b*, the chain member 240*c*, or the string member 240*d*. However, it should be understood that the movable leg-strike units 200 may be connected to the waist-mounted unit 100 by diverse means other than described.

Figure 7:
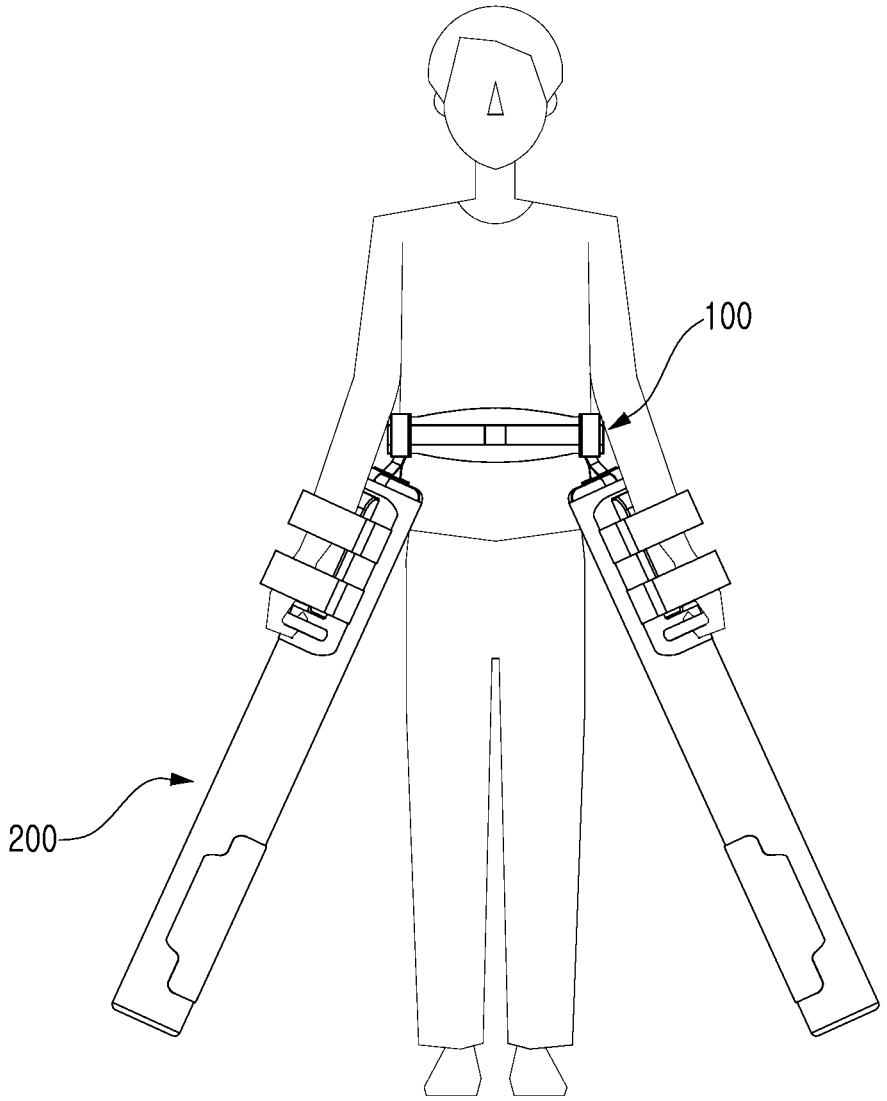
FIGS. 7 to 9 are views showing use states of the martial arts training device according to an exemplary embodiment.
Figure 8:
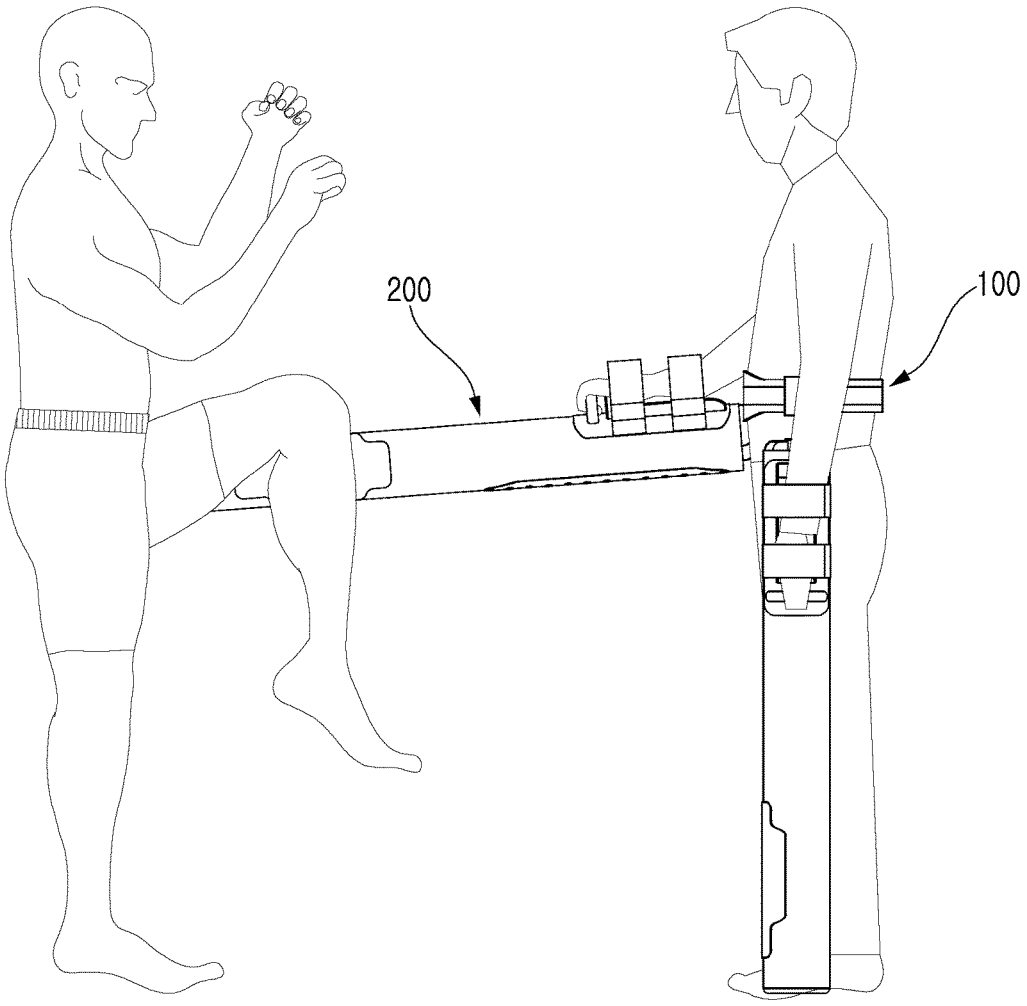
Figure 9:
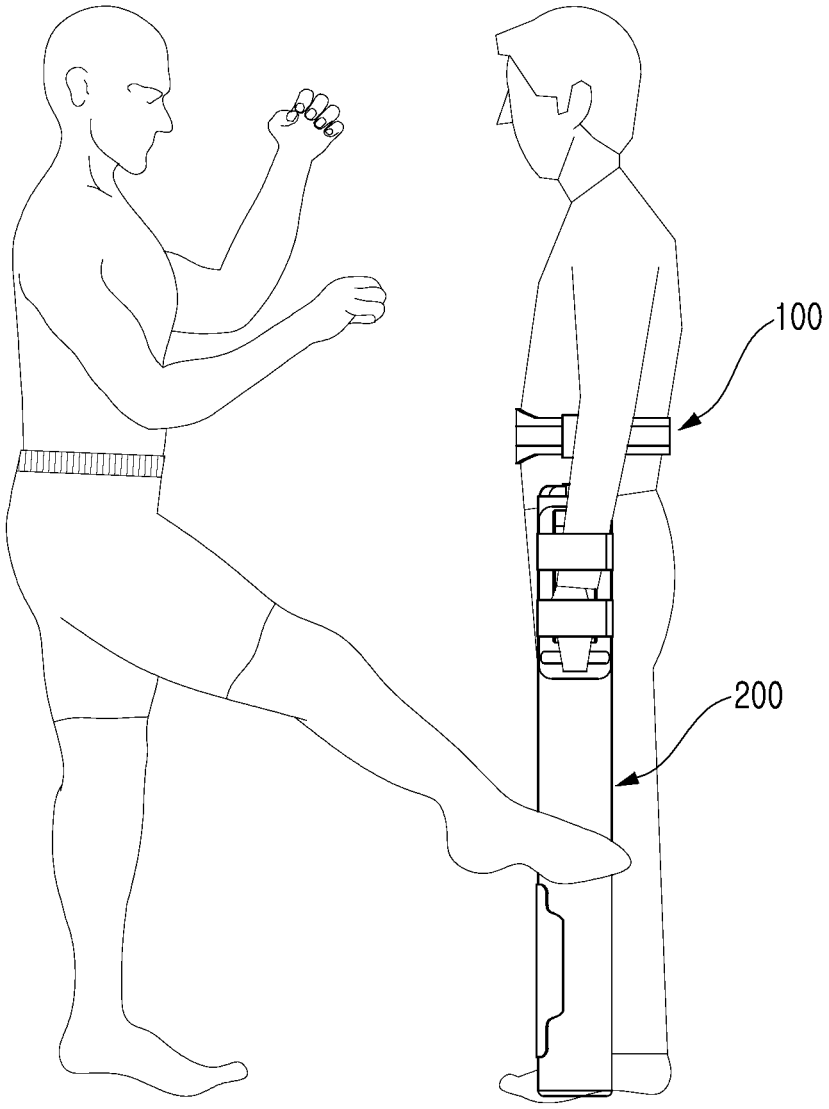

Hereinbelow, operations of the martial arts training device according to an exemplary embodiment will be described with reference to FIGS. 7 to 9.

First, the trainer wears the waist-mounted unit 100 and adjusts its length to confirm to his waist size, and inserts his hands into the arm-binding members 250 on the opposite sides of the movable leg-strike units 200 and holds the handle 210. At this time, his lower arm portion is in close contact with the arm-supporting cushion member 260 and his wrist portion is in close contact with the wrist-protecting cushion member 270.

Then, the trainer moves the movable leg-strike units 200 to simulate a kick toward the trainee. The movable leg-strike units 200 may be moved by the trainer at similar directions, speeds and strengths to kicking in an actual fight, making it possible for the trainee to conduct defensive kicking training. After the trainee defends the movable leg-strike units 200 moved toward him with use of his legs or arms, he/she can conduct offensive training to attack the trainer. Accordingly, diverse training such defense, attack after defense, attack, etc. to train for actual fights is possible, and reflexes can also be enhanced.

The martial arts training device according to the present disclosure is worn on the trainer's waist. As a pair of movable leg-strike units 200 provided on the outer surface of both of his legs are controlled at similar directions, speeds and strengths to kicking around the hip-joint portion, and defensive and offensive training for actual fights may be performed as the trainee defends from and kicks the movable leg-strike units 200.

Some exemplary embodiments of the present disclosure have been described. However, it will be obvious to those of ordinary skill in the art that the present disclosure can be embodied in other various modes without departing from the spirit and category thereof. Accordingly, the present disclosure should therefore not be limited by the above described embodiments.

What is claimed is:

1. A martial arts training device comprising:

a waist belt configured to be worn on a waist;

a first leg-strike unit movably connected to the waist-belt, the first leg-strike unit further including a first outer cover and a first buffer provided inside the first outer cover, wherein the first leg-strike unit has a cylinder shape;

a second leg-strike unit movably connected to the waist belt, the second leg-strike unit further including a second outer cover and a second buffer provided inside the second outer cover, wherein the second leg-strike unit has a cylinder shape;

a handle provided on each of the first and second outer covers;

an arm-supporting cushion disposed on each of the first and second outer covers above the handle to elastically support an arm; and a wrist-protecting cushion provided on each of the first and second outer covers and integrally formed on a bottom portion of the arm-supporting cushion to support a wrist, wherein the first and second outer covers are movably connected to the waist belt.

2. The martial arts training device according to claim 1, wherein the waist belt has a width at a portion different from a width of the waist belt at another portion.

3. The martial arts training device according to claim 1, wherein the first and second outer covers each include an inlet to allow the first and second buffers to be inserted into or removed from the first and second outer covers, respectively.

4. The martial arts training device according to claim 1, wherein the outer covers are formed of natural leather, artificial leather, natural fiber, or man-made fiber, and wherein the buffers are formed of compressed sponge, foamed rubber, foamed silicon resin, or latex.

5. The martial arts training device according to claim 1, further comprising a strap connecting the first outer cover and the waist belt or connecting the second outer cover and the waist belt, wherein the strap is formed of natural fiber or man-made fiber.

6. The martial arts training device according to claim 1, further comprising a ball-joint connecting the first outer cover and the waist belt or connecting the second outer cover and the waist belt, wherein the ball-joint is formed of metal or synthetic resin.

7. The martial arts training device according to claim 1, further comprising a chain connecting the first outer cover and the waist belt or connecting the second outer cover and the waist belt, wherein the chain is formed of metal or synthetic resin.

8. The martial arts training device according to claim 1, further comprising a string connecting the first cover and the waist belt or connecting the second outer cover and the waist belt, wherein the string is formed of metal or synthetic resin.

9. The martial arts training device according to claim 1, further comprising an arm-binding configured to accommodate an arm and disposed on each of the first and second outer covers.

10. The martial arts training device according to claim 9, wherein the arm-binding comprises a plurality of straps which are spaced apart from each other.

11. The martial arts training device according to claim 1, wherein a reinforcement pad is provided in a front lower portion of each of the first and second outer covers.

* * * * *